US005088848A

United States Patent [19]

De Falco et al.

[11] Patent Number: 5,088,848

[45] Date of Patent: Feb. 18, 1992

[54] PRINTING SHEET FEED AND ALIGNING SYSTEM FOR A PRINTER

[75] Inventors: Gianfranco De Falco, Samone; Antonio Brunero, Cossano, both of Italy

[73] Assignee: Ing. Olivetti & C., S.p.A., Aver, Italy

[21] Appl. No.: 671,469

[22] Filed: Mar. 19, 1991

[30] Foreign Application Priority Data

Mar. 20, 1990 [IT] Italy ..... 67200 A/90

[51] Int. Cl.[5] ..... B41J 13/26

[52] U.S. Cl. ..... 400/630; 400/579; 400/56

[58] Field of Search ..... 400/579, 630, 631, 632, 400/632.1, 633, 636, 641, 55, 56, 59; 271/227, 236, 245, 248, 237, 238, 246

[56] References Cited

U.S. PATENT DOCUMENTS

| | | | |
|---|---|---|---|
| 3,430,947 | 3/1969 | Davis | 271/246 |
| 4,023,662 | 5/1977 | Perucca | 400/59 |
| 4,174,908 | 11/1979 | Wehler | 400/56 |
| 4,420,269 | 12/1983 | Ackermann et al. | 400/56 |
| 4,897,670 | 1/1990 | Hasegawa et al. | 400/55 |
| 4,909,374 | 3/1990 | Skrypalle | 271/246 |
| 4,989,855 | 2/1991 | Polic | 271/227 |

OTHER PUBLICATIONS

IBM Tech. Disclosure Bulletin, vol. 32, No. 6B, 11/89, Barrel Roll for Document Alignment.

IBM Tech. Disclosure Bulletin, vol. 29; No. 7, 12/86, Dual Direction, Varying Force Sheet Aligner.

*Primary Examiner*—Edgar S. Burr

*Assistant Examiner*—Ren Yan

*Attorney, Agent, or Firm*—Banner, Birch, McKie & Beckett

[57] ABSTRACT

Two rollers with lobes for feeding a sheet are disposed below the plane feed surface. The two rollers are rotatable on axes perpendicular to one another and move the sheet or the document to be printed in a direction perpendicular and parallel, respectively, to the printing direction of the head to align the sheet against retractable stop elements movable parallel to the printing direction and against a lateral guide perpendicular to the printing direction. Suitable optical sensors detect a possible misalignment of the sheet and cause a further rotation of the rollers to complete the alignment of the sheet against the guides; in case a document such as an accounting book is to be fed, a testing device detects the thickness of the document for positioning the head at a prefixed distance from the printing surface of the document itself.

17 Claims, 6 Drawing Sheets

82
28
98
III
96
13
97
91
102
85
86
104
90
26
95
94
50
46
80
74
16
14
18
22
44
52
53
56
54
55
155
76
68
70
72
77
157
36
40
37
156
158
41
121
120
112
88
11

PRINTING SHEET FEED AND ALIGNING SYSTEM FOR A PRINTER

BACKGROUND OF THE INVENTION

The present invention relates to a printing sheet feed and aligning system for a printer, in which at least one feed roller is located below the plane feed surface of the printing sheet and has lobes projecting above the said surface for feeding the printing sheet towards the printing zone by friction.

Normally, in known systems, a sheet is fed by means of friction rollers in a feed direction perpendicular to the printing direction of the head until it is against retractable stops or aligning elements disposed perpendicularly to the feed direction of the sheet. In some cases, especially when the sheet is positioned incorrectly by the operator on the feed surface, the aligning elements are not sufficient for aligning the sheet correctly with respect to the printing direction.

SUMMARY OF THE INVENTION

Therefore an object of the invention is to provide a printing sheet feed and aligning system for a printer capable of feeding and aligning a sheet correctly with respect to the printing direction of the head, even when it is placed incorrectly on the feed surface by the operator.

The object is achieved by the printing sheet feed and aligning system of the invention wherein a printing head is movable along a printing line and a first feed roller is rotatable to feed the printing support against a movable stop aligned in a direction parallel to the printing line, a second feed roller being rotatable to feed the printing support in a direction of alignment parallel to the printing line against a lateral guide perpendicular to the printing line, the second feed roller being kinematically connected to the first roller, each roller comprising a pair of the projections being mutually offset by 90°.

BRIEF DESCRIPTION OF THE DRAWINGS

This characteristic and other characteristics of the invention will appear more clearly from the following description of a preferred embodiment, given by way of example, but non-limitatively, with reference to the accompanying drawings, in which.

DETAILED DESCRIPTION OF THE PREFERRED EMBODIMENT

Figure 1:
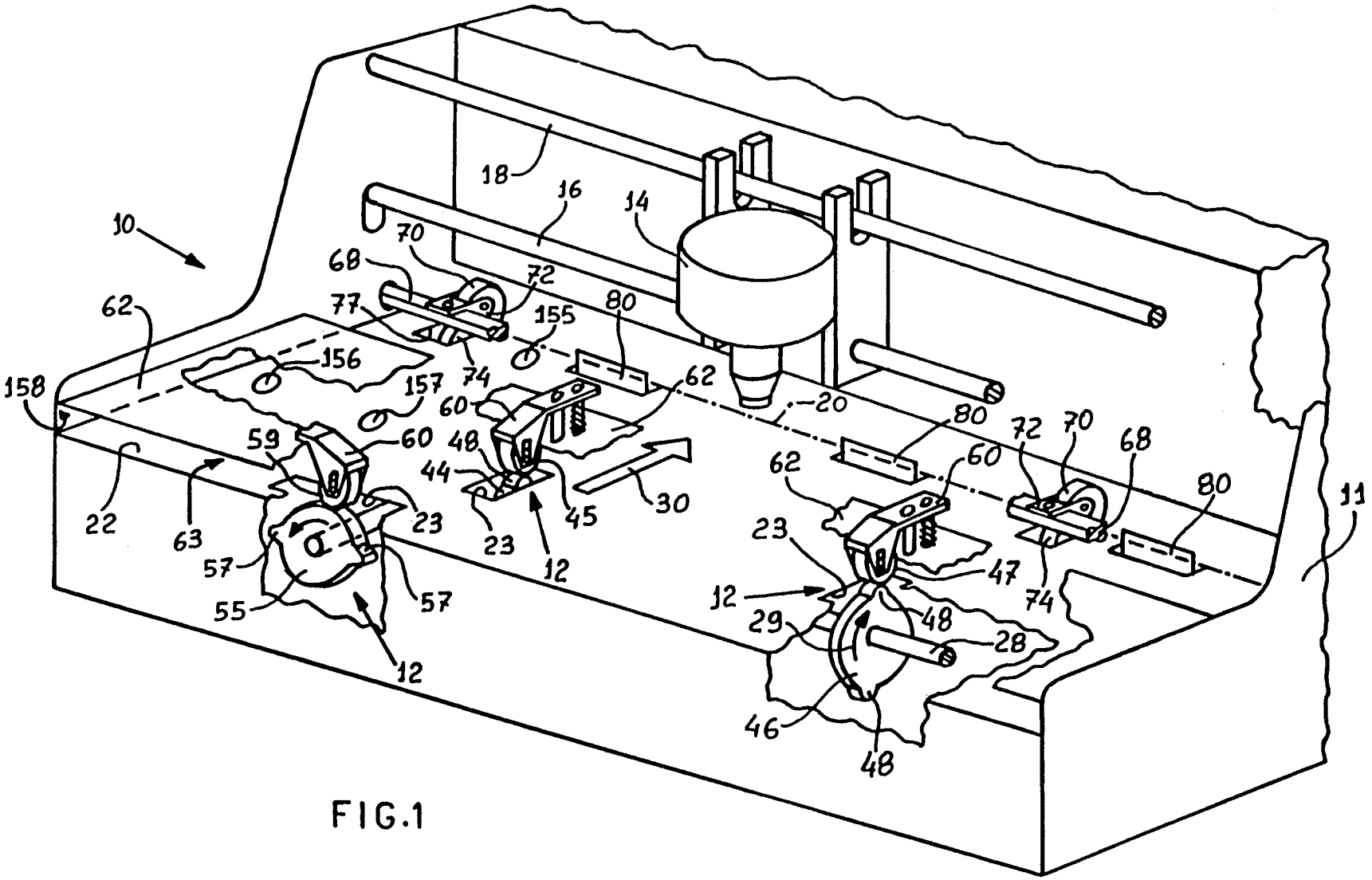
FIG. 1 is a partial perspective view of the feed and aligning system for a printer according to the invention.

FIG. 1 shows in perspective a partial view of a printer 10 incorporating a sheet feed and aligning systems 12 according to the invention.

The printer 10 comprises a printing head 14 slidable along parallel guides 16 and 18. The head 14 can print information along a printing line 20, indicated by a chain-dotted line and parallel to the direction of the guides 16, 18, on printing supports constituted, for example, by single sheets, preprinted forms or account books. In the continuation of the description, such printing supports will be referred to generically as sheets. A sheet is inserted manually by an operator on a plane support and feed surface 22.

Figure 2:
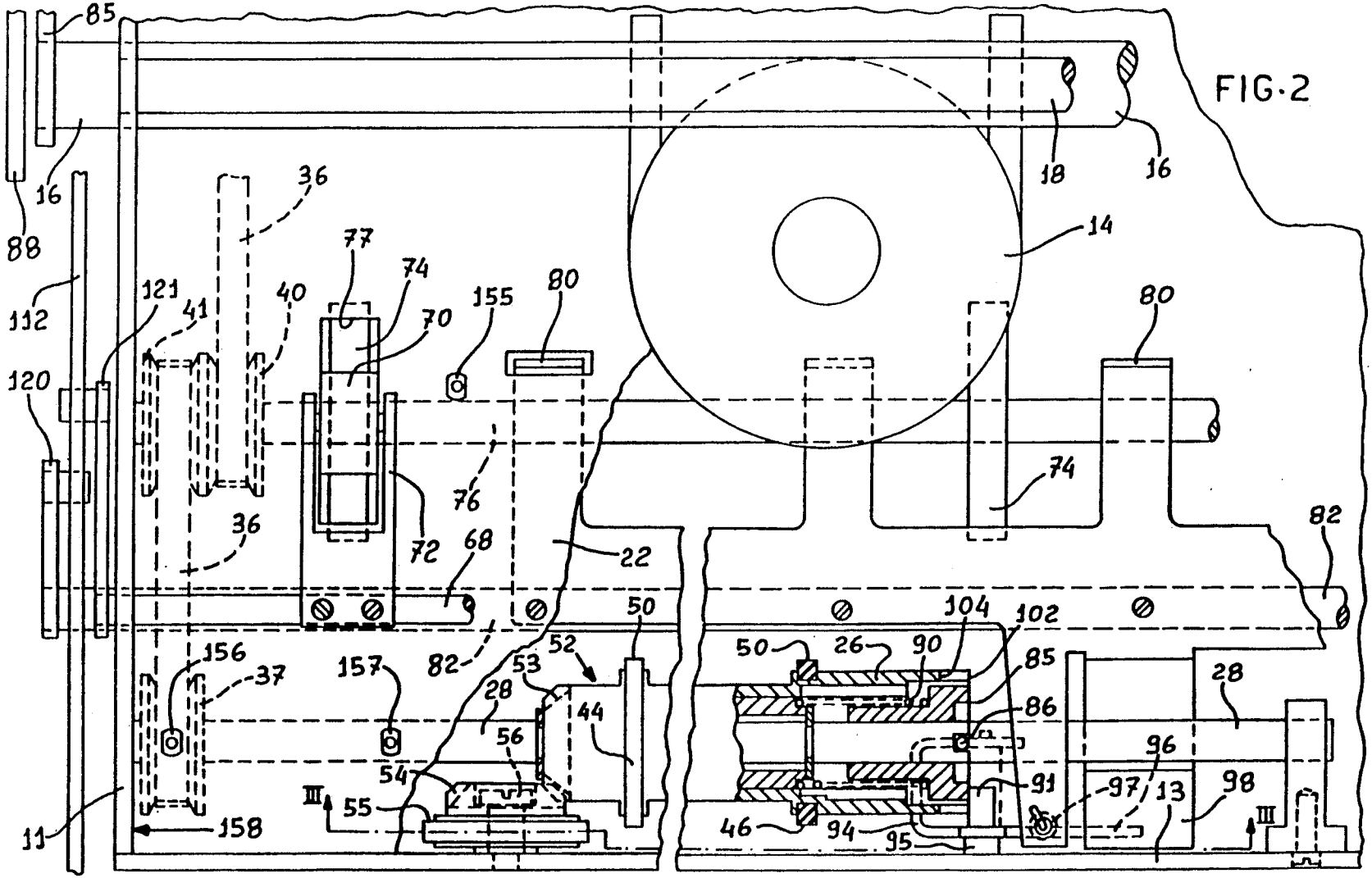
FIG. 2 is a plan view of the system of FIG. 1.

The sheet feed and aligning system 12 comprises a sleeve 26 (FIG. 2) located below the surface 22 and mounted loosely on a shaft 28 perpendicular to the feed direction of the sheet, indicated by an arrow 30 in FIG. 1. The shaft 28 can revolve on the structure of the printer 10 and is rotated by an electric motor 34 (FIG. 5) by means of two belts 35 and 36 (FIGS. 2 and 5) passed around pulleys 39 and 40, 41, respectively. The sleeve 26 is provided with two rollers 44, 46 for feeding the sheets in the direction 30 perpendicular to the printing line 20. Each of the rollers 44 and 46 is shaped so as to present two diametrically opposed projections or lobes 48. The lobes 48 are covered with a layer 50 of soft rubber with a high coefficient of friction.

At one end 52, the sleeve 26 has a bevel toothing 53 meshing with a corresponding toothing 54 integral with a second roller 55 rotating on a pin 56 perpendicular to the shaft 28. The roller 55 is also provided with two lobes 57 which are diametrically opposed and offset by 90° with respect to the orientation of the lobes 48. The rollers 44, 46 and 55 are disposed in such manner that the lobes 48 and 57 project above the surface 22 through slots 23. The transmission ratio between the bevel toothings 53 and 54 is 1:1, for which reason the roller 55 turns at the same speed as the sleeve 26.

The lobed rollers 44, 46 and 55 cooperate with counter-rollers 45, 47 and 59 (FIGS. 1 and 3), respectively, mounted on supports 60. The supports 60 are fulcrumed on a vertical pin 61 fixed to a plate 62 parallel to the plane surface 22 and suitably spaced from the latter to form an entry slot 63 for the sheet which is to be introduced into the printer 10. A pressure spring 65 loads the support 60, opposing its rotation anticlockwise.

Each of the rollers 45, 47 and 59 is made of steel and has a weight of about 30 grams. It is pivoted on the support 60 in vertical slots 67 which permit a limited vertical movement of the roller itself to allow the passage of sheets of variable thickness. The weight of the rollers 45, 47, 59 is sufficient, in combination with the coefficient of friction of the rubber 50, to transport sheets of conventional weight per unit of area.

When a bank account book having a maximum thickness of about 5 mm is inserted into the slot 63, the rollers 45, 47, 59 raise the support 60 which, by the effect of the load exerted by the spring 65, exerts on the book a force sufficient for it to be advanced by the rollers 44, 46, 55.

Mounted on a shaft 68 (FIGS. 1 and 2) parallel to the printing line 20 are counter-rollers 70 rotatable on arms 72 fixed to the shaft 68 to overhang therefrom. The counter-rollers 70 cooperate with corresponding feed rollers 74 keyed on a shaft 76 rotatable in the frame 11 below the surface 22 and emerging through slots 77.

The shaft 68 can be rotated in the manner hereinafter described to move the counter-rollers 70 away from the corresponding rollers 74. The pulleys 40, 41 are mounted on the shaft 76 and, therefore, the shaft 76 is rotated by the motor 34 (FIG. 5) in synchronism with the rotation of the shaft 28.

A group of retractable stops elements 80 (FIGS. 2, 4) is disposed in the vicinity of the rollers 74 and aligned perpendicularly to the feed direction 30 of the sheet.

The elements 80 are mounted on a shaft 82 pivoted on the frame 11 and project above the surface 22 in the rest position to intercept the front edge of a sheet and therefore align it correctly with respect to the printing line 20. The shaft 82 can be turned clockwise (FIG. 4), as will be seen hereinafter, to retract the elements 80 below the surface 22 and thus permit the feed of a sheet or an account book towards the printing zone.

As has already been said hereinbefore, the shaft 28 is rotated by the belt 36 (FIG. 2) passed around the pulley 41 and around a pulley 37 keyed on the shaft 28. Inside the sleeve 26, a bush 85 coaxial therewith can slide axially, but is carried along in rotation by the shaft 28 by means of a radial peg 86 fixed on the shaft 28.

Figure 3:
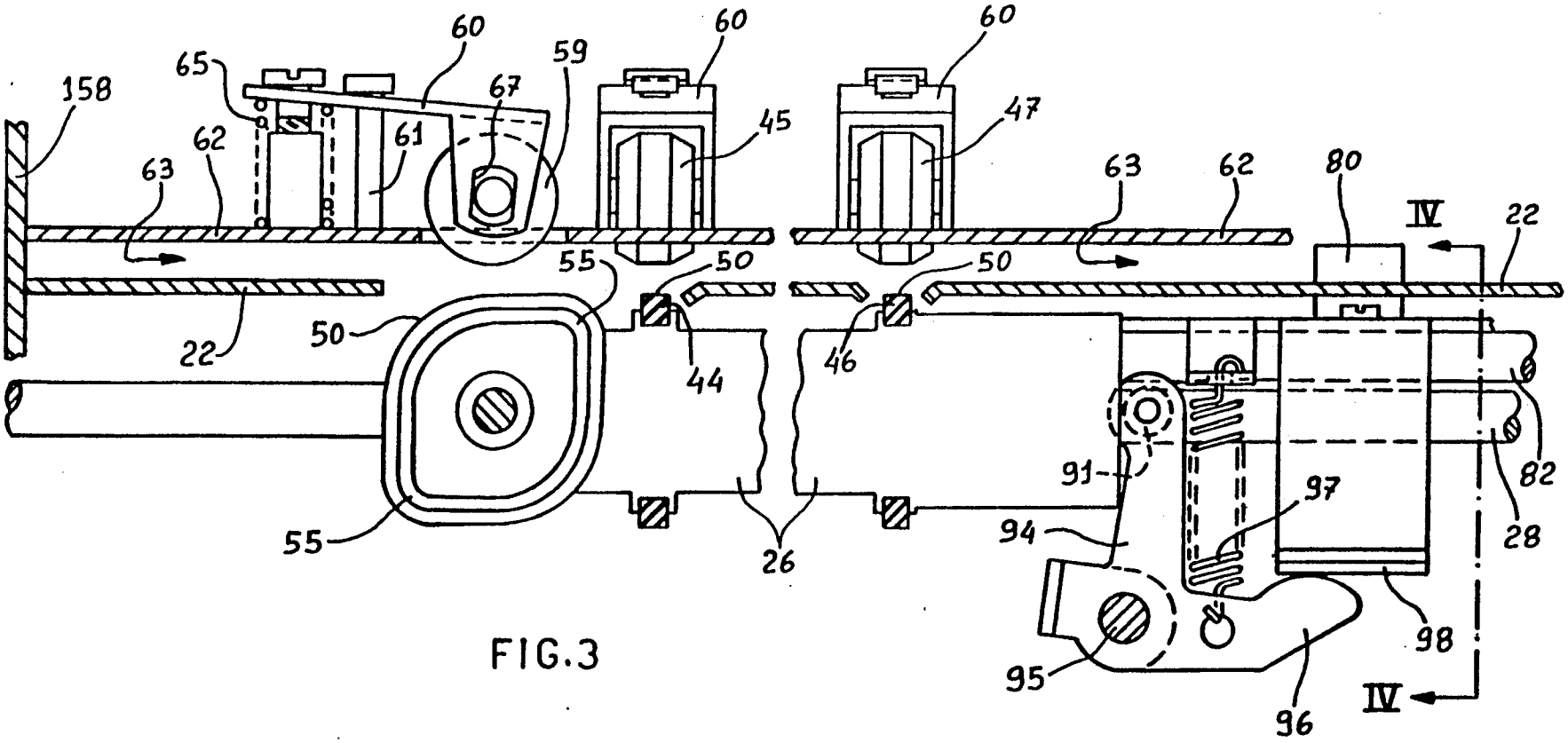
FIG. 3 is a section on the line III—III of FIG. 2.
Figure 4:
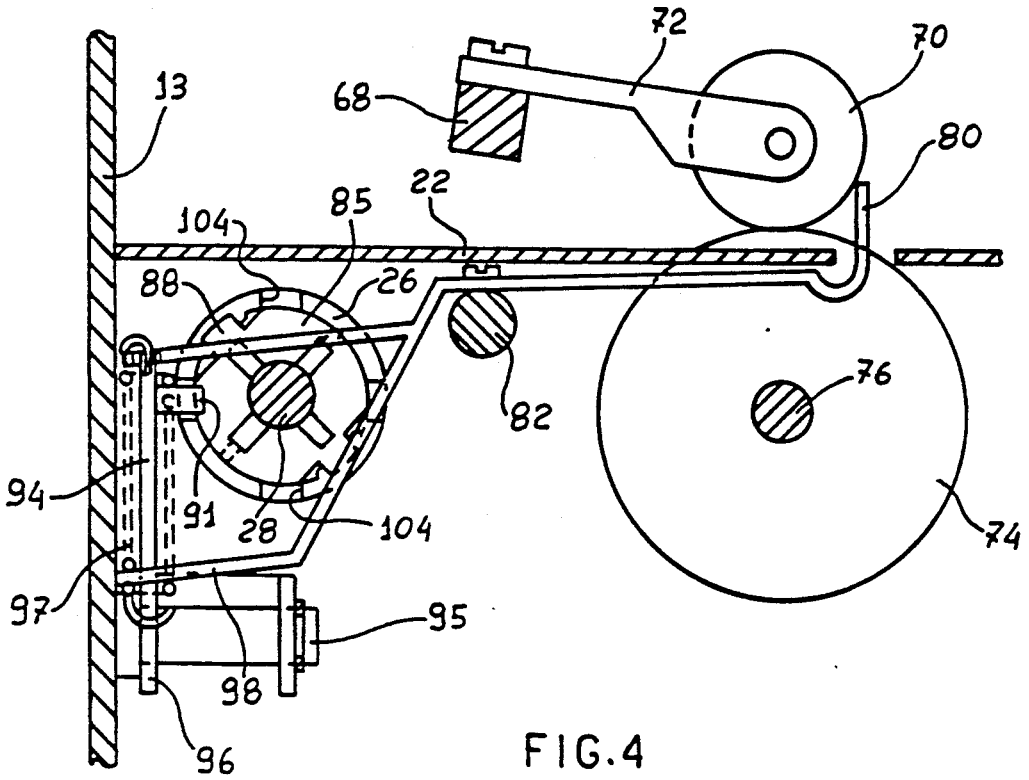
FIG. 4 is a section on the line IV—IV of FIG. 3.

The bush 85, in turn, carries the sleeve 26 along in rotation by means of radial teeth 88 (FIG. 4). The bush 85 is shifted axially (FIG. 2) in opposition to the action of a spring 90 by means of a stud 91 of a bell-crank lever 94 (FIGS. 3, 4) pivoted on a fixed pin 95.

An arm 96 of the lever 94 is held by a spring 97 bearing against a tab 98 integral with the elements 80. The lever 94 is rotated positively anticlockwise by the spring 97 when the shaft 82 turns clockwise in FIG. 4 to lower the elements 80 below the surface 22.

On the edge 102 of the sleeve 26 there are formed notches 104 into each of which the stud 91 is urged by the spring 97, as will be described hereinafter.

The printing head 14 is movable vertically to be positioned at a suitable distance from the printing surface as a function of the thickness of the sheets or of the account book introduced.

Figure 5:
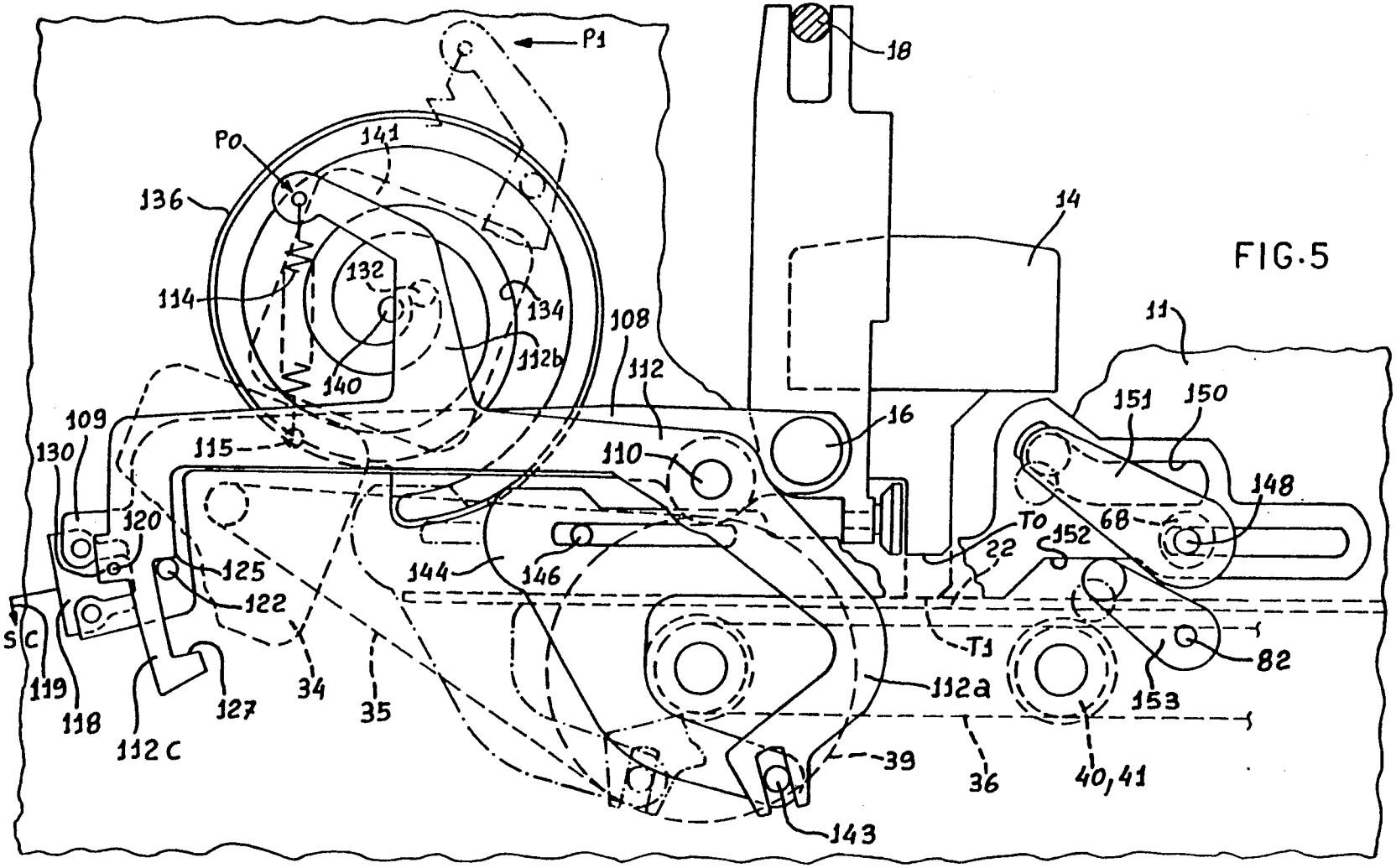
FIG. 5 is a side view of the device for adjusting the distance of the head from sheet.

To this end, the guide rod 16 of the head 14 can shifted parallel to itself by means of a control device illustrated in FIG. 5 and situated on one side of the printer 10.

The rod 16 is fixed at its ends to a pair of levers, of which there is visible in FIG. 5 a first lever indicated by the reference 108 and located on the left side of the printer 10 with respect to the direction of introduction of the sheets. The lever 108 can turn about the axis of a shaft 110 parallel to the guide 16 and rotatable in the frame 11. Therefore, a rotation of the lever 108 in one direction or the other causes a corresponding vertical shifting of the head 14.

On the shaft 110 there is also fulcrumed a second lever 112 having three arms 112*a*, 112*b*, 112*c*. The lever 112 is connected to the lever 108 by means of a draw spring 114 stretched between the arm 112*b* and a point 115 of the lever 108.

On one end 109 of the lever 108 there is fixed an optical sensor 118 of known type which is able to emit a light beam indicated in FIG. 5 by the reference 120.

The end 109 bears a stud 122 cooperating with two stop teeth 125 and 127 of the lever 112 to limit the angular amplitude of the relative rotation of the lever 112 with respect to the lever 108. When the levers 108 and 112 are in the inoperative position, indicated in solid lines in FIG. 5, the light beam 120 is intercepted by an obturator 130 formed on the arm 112*c*, while if the lever 108 turns by a small angle with respect to the lever 112, the sensor 118 is struck by the beam 120 and generates a control signal SC on a wire 119, as will be described in greater detail hereinafter. On the arm 112*b* there is fixed a stud 132 engaged in a groove 134 in the form of a spiral in a cam element 136. The element 136 is mounted on a shaft 140 of an electric stepping motor 141.

When the motor 141 rotates the element 136 anticlockwise, the lever 112 is rotated clockwise about the axis of the shaft 110, passing from the rest or inoperative position Po to the extreme position P1.

Owing to the effect of the spring 114, the lever 108 follows the lever 112 in its rotation, shifting the head 14 vertically from an upper position To to a lower position T1.

The arm 112*a* is coupled to a stud 143 of a slider 144 slidable on two bearing pins 146 and 148. The slider 144 bears two cam profiles 150 and 152 adapted to rotate the shafts 68 and 82, respectively, by means of two arms 151 and 153.

Disposed on the supporting surface 22 are three optical sensors 155, 156, 157 (FIG. 2) prearranged to signal the position of a sheet supported on the surface 22. More particularly, the sensor 157 detects the introduction of a sheet into the slot 63. The front sensor 155 detects the front edge of the sheet in the proximity of the elements 80.

Finally, the lateral sensor 156 detects the lateral edge of the sheet when it is positioned in the proximity of the side wall or guide 158.

The feed system operates in the following manner. During the waiting state, the motor 34 and the motor 141 are at a standstill. The cam element 136 is positioned as in FIG. 5, in which the lever 112*b* is in the position Po. The head 14 is therefore raised in the position To and the slider 144 is shifted to the right, whereby the elements 80 and the counter-rollers 70 are raised. Under these conditions, the tab 98 (FIGS. 2 and 4) is lowered, so that the stud 91 of the bell-crank lever 94 is out of the notches 104 of the sleeve 26, which is therefore engaged with the peg 86. The shaft 28 transmits the rotation to the sleeve 26 and to the friction rollers 44, 46 and 55. Since the lobes 57 of the roller 55 are out of phase with a delay of 90° with respect to the lobes 48 of the rollers 44 and 46, when the shaft 28 (FIG. 1) is rotated in the direction of the arrow 29, each sheet is first fed in the direction 30 (FIG. 1) and then in the perpendicular direction towards the guide 158.

Figure 6:
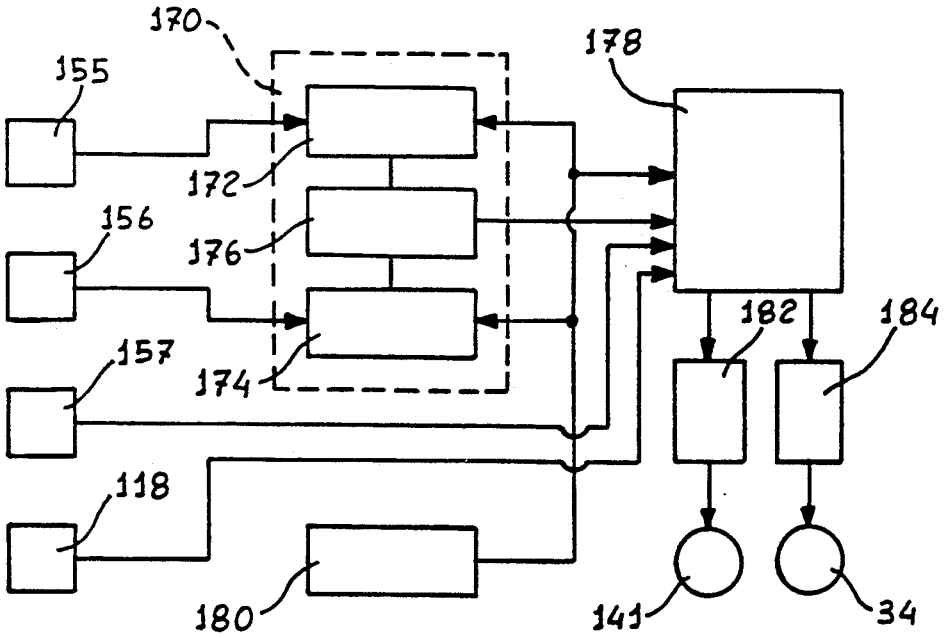
FIG. 6 is a block diagram of the control circuit of the feed system.
Figure 7:
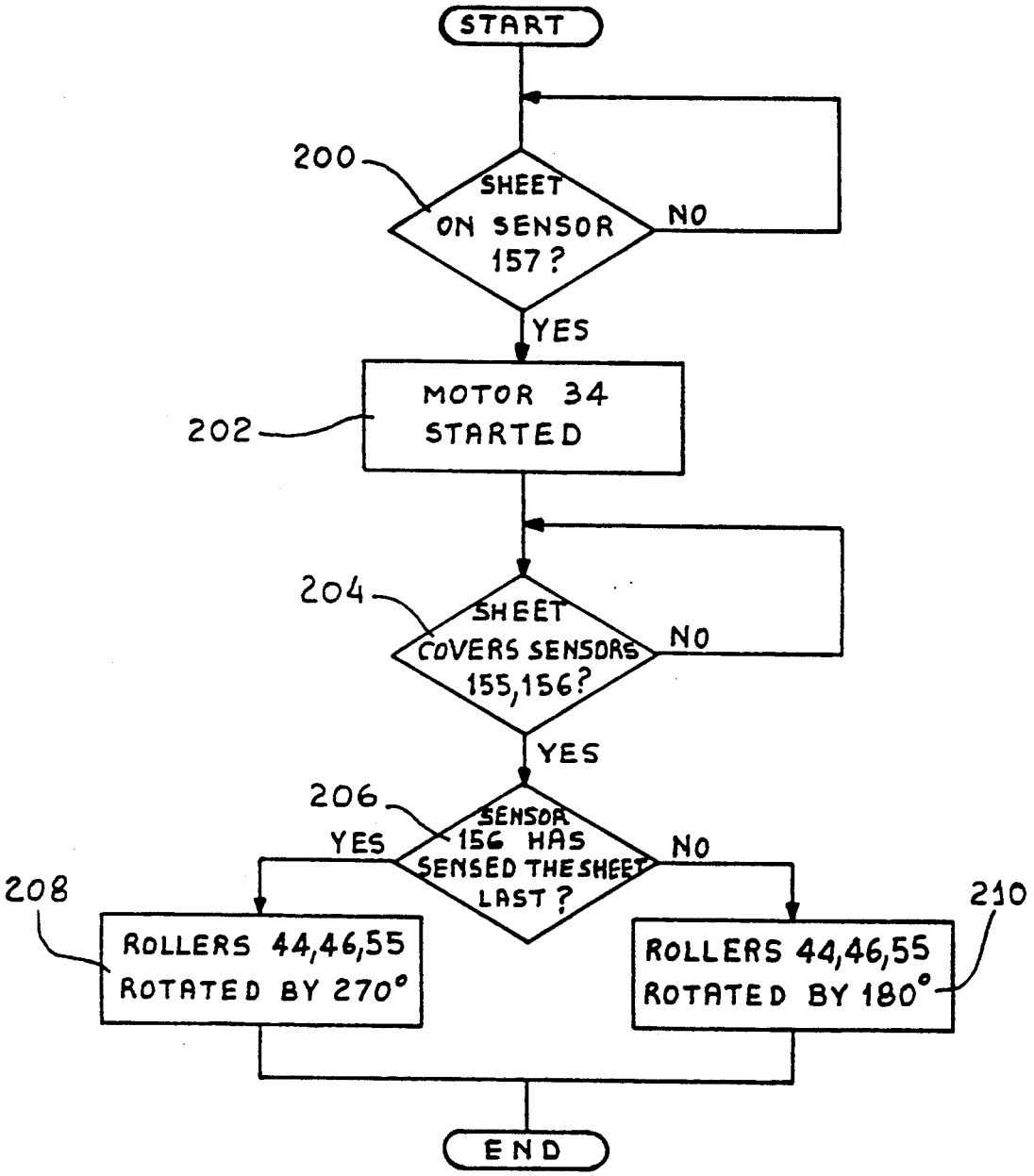
FIG. 7 is a flow diagram of commands and operations executed by the circuit of FIG. 6.

The stage of feeding and aligning a sheet against the lateral guide 158 is controlled by a logic circuit represented in FIG. 6, while the corresponding succession of commands and controls is indicated in FIG. 7.

Referring to FIG. 6, the front sensor 155 and the lateral sensor 156 are connected to a comparison circuit 170 indicated diagrammatically in dash lines. The circuit 170 comprises substantially a counter 172 associated with the sensor 155, a counter 174 associated with the sensor 156 and a comparator circuit 176 connected to the two counters 172, 174 and a control unit 178. A timer 180 sends a succession of pulses for the timing to the counters 172, 174 and to the control unit 178, as is known in the art of the operations performed by the unit 178. The entry sensor 157 is connected to the unit 178 for controlling the motor 34 of the feed rollers.

The sensor 118 is also connected to the unit 178 for controlling the motor 141 of the cam element 136. The motors 34 and 141 are driven by driving circuits indicated by the references 182 and 184, respectively, and controlled by the unit 178.

When a sheet or an account book is introduced into the slot 63 (FIG. 1), the sensor 157 is activated. With the operation 200 (FIG. 7), the control circuit detects a signal generated by the sensor 157 which indicates the presence of the sheet and starts (operation 202) the motor 34, which causes the shaft 28 to rotate in the direction of the arrow 29 in FIG. 1. The sheet is then fed intermittently and alternately by the lobes 48 towards the elements 80 and by the lobes 57 towards the lateral guide 158. The feed operation continues until such time (operation 204) as the circuit detects the signals of the sensors 155 and 156 which indicate that the sheet is covering the two sensors 155 and 156. The sensors 155 and 156 send, respectively, a blocking signal to the two counters 172, 174 (FIG. 6), which establish the instants at which the two sensors 155 and 156 detect the front edge and the lateral edge, respectively, of the sheet introduced on to the surface 22 (FIG. 1).

This presupposes that when each of the sensors 155 and 156 senses the corresponding edge of the sheet, a lobe 48 of the rollers 44, 46 or a lobe 57 of the roller 55, respectively, is in engagement with the sheet and is pushing it against the elements 80 or against the lateral guide 158.

It has been observed that, in some cases, when a light sheet of low weight per unit of area, or a very flexible sheet, is introduced on to the surface 22, due to the effect of the thrust of the lobes 48 of the rollers 44, 46, such sheet resiliently forms a bend along the front edge in contact with the elements 80. As soon as the lobes 48 free the sheet in their rotation, the bend formed opens out and pushes the sheet back, causing a misalignment thereof.

In order to obviate this drawback, the rollers 44, 46 and 55 are made to perform a further rotation of a predetermined angle to bring a lobe 48 of the rollers 44, 46 into engagement with the sheet and these rollers are made to stop in the angular position in which these lobes remain in engagement with the sheet and keep it still because of the friction of the rubber 50 and the weight of the counter-rollers 45, 47 (FIG. 3).

To this end, the comparator 176 (operation 206, FIG. 7) compares the counts of the counters 172 and 174 and establishes which of the two sensors 155 or 156 has sensed the corresponding edge of the sheet last.

Therefore, if at a certain instant the lateral sensor 156 has sensed the corresponding edge of the sheet last, it is deduced therefrom that the lobe 57 is in engagement with the sheet at that instant. Since, however, the lobes 48 of the rollers 44, 46 are offset by 90° with respect to the lobes 57, at the instant when the sensor 156 senses the lateral edge of the sheet the lobes 48 are not touching the sheet and therefore the latter could move. The control unit 178 therefore actuates the motor 34 (operation 208, FIG. 7) to cause the rollers 44, 46 and 55 to rotate further by an angle of 270°, corresponding to a first rotation of 90° to bring the lobes 48 into engagement with the sheet a first time and again to a second rotation of 180° to bring the following lobe 48 into contact with the sheet. After this rotation, the motor 34 is stopped.

On the other hand, when at a given instant the lateral sensor 156 has not sensed the corresponding edge of the sheet last, that is when the front sensor 155 has sensed the sheet last, one of the lobes 48 is in engagement with the front edge of the sheet. The unit 178 then commands (operation 210, FIG. 7) a rotation of the rollers 44, 46 for an angle less than in the preceding case, that is of only 180°. In this way, the second of the lobes 48 moves into engagement with the front edge. At this point, the motor 34 is stopped, maintaining the second lobe 48 in engagement with the sheet, which is thus unable to move.

Immediately after the preceding operations, the unit 178 commands the starting of the motor 141 for rotating the cam element 136 (FIG. 5) anticlockwise.

The stud 132 of the lever 112, following the spiral groove 134 from the centre towards the periphery, causes the lever 112 to turn clockwise. The slider 144 is carried along towards the left in FIG. 5 and first causes the shaft 68 to rotate by means of the cam 150, to lower the counter-rollers 70 (FIG. 4) and keep the sheet still. Thereupon, the cam 152 of the slider 144 lowers the elements 80. At the same time, the arm 98 (FIGS. 3, 4) releases the bell-crank lever 94 which, by the action of the spring 97, introduces the stud 91 into one of the notches 104 of the sleeve 26. The bush 85 is pushed inside the sleeve 26 and is released from the peg 86. The shaft 28 can therefore rotate without causing the rollers 44, 46 and 55 to rotate.

Also, simultaneously with the lowering of the elements 80, the unit 178 starts the motor 34 which, by means of the rollers 74, feeds the sheet below the head 14 as far as a predetermined printing position established by a main logic circuit not shown in the drawings.

In the meantime, the head 14 continues to lower itself by the action of the lever 108, which is carried along by the lever 112 by means of the spring 114. When the head 14 touches the sheet, the lever 108 stops, while the lever 112 continues to turn by a small angle until the sensor 118 is intercepted by the light beam 120. At this point, the unit 178 (FIG. 6) arrests the motor 141 and causes it to rotate in the opposite direction to raise the head 14 by an amount sufficient to guarantee an optimum quality of printing on the subjacent sheet.

It is understood that modifications, additions or substitutions of parts may be made to or in the sheet feed and aligning system which has just been described without, however, departing from the scope of the present invention.

What is claimed is:

1. A printing sheet feed and aligning system for a printer, said system comprising:

a printing head movable along a printing line;

a plane bearing surface for receiving a sheet to be printed on and having movable stop means aligned in a direction parallel to said printing line;

at least one first feed roller rotatable to feed said sheet on said plane surface against said stop means;

lateral guide means at the side of said plane surface and perpendicular to said printing line; and a second feed roller rotatable to feed said sheet in a direction of alignment parallel to said printing line against said lateral guide means, said second roller being coupled to said first roller for rotation therewith;

said first and second rollers each comprising a pair of substantially diametrically-opposed radial projections, the pair of projections on said first roller being relatively offset with reference to the pair of projections on said second roller by about 90°.

2. A system as claimed in claim 1, in which said first roller is rotatable on a first shaft parallel to said printing line and said second roller is rotatable on a second shaft perpendicular to said first shaft, said second roller being rotated by said first roller with a transmission ratio of 1:1.

3. A system as claimed in claim 1, comprising a front sensor located in the proximity of said movable stop means to sense a front edge of said sheet, and a lateral sensor located in the proximity of said lateral guide means for sensing a lateral edge of said sheet.

4. A system as claimed in claim 3, comprising a control unit, a comparison circuit connected to said control unit and to said sensors, and actuating means for said rollers controlled by said control unit for stopping said first roller on command of said sensors with one of said projections in engagement with said sheet.

5. A system as claimed in claim 4, in which said comparison circuit detects instants at which said sensors sense said front edge and said lateral edge, respectively, and, when said lateral edge is sensed after said front edge, said comparison circuit enables said actuating means to rotate said rollers by a further predetermined angle, while when said front edge is sensed after said lateral edge, said comparison circuit enables said actuating means to rotate said rollers by an angle less than said predetermined angle.

6. A system as claimed in claim 5, in which said predetermined angle is 270° and said lesser angle is 180°.

7. A system as claimed in claim 1, in which said printing head can move vertically to adopt a plurality of positions as a function of the thickness of said printing sheet, and said system comprises a rotatable cam element, a first lever connected to said printing head, a second lever connected to said first lever by means of a spring and moved by said cam element, and sensor means adapted to detect relative rotation of said first and second levers to block rotation of said cam element.

8. A system as claimed in claim 7, including a rotatable shaft having a lever arm fixed thereto and a slider, said movable stop means being mounted on said rotatable shaft and turned by said first lever by means of said slider and by means of said lever arm cooperating with said slider.

9. A system as claimed in claim 7, including a control unit responsive to said sensor means, and a stepping motor controlled by said control unit, wherein said cam element is rotated by said motor, whereby vertical movement of said head is stopped when said head rests on said printing sheet.

10. A system as claimed in claim 8, including a control unit responsive to said sensor means, and a stepping motor controlled by said control unit to rotate said cam element, whereby vertical movement of said head is arrested when said head rests on said printing sheet.

11. In a printer having a printing head movable along a printing line, a printing sheet feed and alignment system comprising:

a plane bearing surface for receiving a sheet to be printed on and having movable stop means aligned in a direction parallel to said printing line;

a least one first feed roller rotatable to feed said sheet on said plane surface against said stop means;

a front sensor located in the proximity of said stop means to sense a front edge of said sheet;

lateral guide means at the side of said plane surface and perpendicular to said printing line;

a second feed roller rotatable to feed said sheet in a direction of alignment parallel to said printing line against said lateral guide means;

a lateral sensor located in the proximity of said lateral guide means for sensing a lateral edge of said sheet;

actuating means for driving said rollers;

comparison means coupled to said sensors to detect the instants at which said sensors sense said front edge and said lateral edge respectively, and, when said lateral edge is sensed after said front edge, causing said actuating means to rotate said rollers by a first predetermined amount, and when said front edge is sensed after said lateral edge, causing said actuating means to rotate said rollers by a second amount which is different from said first amount.

12. The invention as claimed in claim 11, in which said second amount is less than said first amount.

13. The invention as claimed in claim 11 in which said rollers have equally-spaced projections thereon, said second roller is coupled to said first roller for rotation therewith, and said projections on said second roller lie relatively intermediate the projections on said first roller.

14. A printing head mounting system comprising:

a printing head movable along a printing line;

a plane bearing surface for receiving a sheet to be printed on and having movable stop means aligned in a direction parallel to said printing line;

means for feeding said sheet on said plane surface into engagement with said stop means; and means mounting said printing head for movement towards and away from said plane surface to adopt a plurality of positions as a function of the thickness of said sheet, said mounting means comprising:

rotatable cam means;

a first lever coupled to said printing head;

a second lever;

resilient biasing means coupling said second lever to said first lever for movement by said cam means; and sensor means for detecting relative rotation of said first and second levers to block rotation of said cam means.

15. A system as claimed in claim 14, including a rotatable shaft having a lever arm fixed thereto and a slider, said moveable stop means being mounted on said rotatable shaft and turned by said first lever by means of said slider and by means of said lever arm cooperating with said slider.

16. A systems as claimed in claim 14, including a control unit responsive to said sensor means, and a stepping motor controlled by said control unit, wherein said cam element is rotated by said motor, whereby vertical movement of said head is stopped when said head rests on said printing sheet.

17. A system as claimed in claim 16, including a control unit responsive to said sensor means, and a stepping motor controlled by said control unit to rotate said cam element, whereby vertical movement of said head is arrested when said head rests on said printing sheet.

* * * * *